US010294954B2

(12) United States Patent
Rice

(10) Patent No.: US 10,294,954 B2
(45) Date of Patent: May 21, 2019

(54) COMPOSITE BLISK

(71) Applicant: Rolls-Royce North American Technologies Inc., Indianapolis, IN (US)

(72) Inventor: Edward C. Rice, Indianapolis, IN (US)

(73) Assignee: ROLLS-ROYCE NORTH AMERICAN TECHNOLOGIES INC., Indianapolis, IN (US)

( * ) Notice: Subject to any disclaimer, the term of this patent is extended or adjusted under 35 U.S.C. 154(b) by 394 days.

(21) Appl. No.: 15/347,077

(22) Filed: Nov. 9, 2016

(65) Prior Publication Data

US 2018/0128282 A1 May 10, 2018

(51) Int. Cl.

*F04D 29/02* (2006.01)
*F04D 29/26* (2006.01)
*F04D 29/32* (2006.01)

(52) U.S. Cl.

CPC ..... *F04D 29/322* (2013.01); *F04D 29/023* (2013.01); *F04D 29/266* (2013.01); *F04D 29/324* (2013.01)

(58) Field of Classification Search

CPC ..... F04D 29/02; F04D 29/023; F04D 29/263; F04D 29/266; F04D 29/322; F04D 29/324; F01D 5/02; F01D 5/021; F01D 5/025; F01D 5/282; F01D 5/3007; F01D 5/323; F01D 5/326; F01D 5/34; B23P 15/02; B23P 15/04; Y10T 29/49801; Y10T 29/4998

USPC ..... 416/234

See application file for complete search history.

(56) References Cited

U.S. PATENT DOCUMENTS

| | | | | |
|---|---|---|---|---|
| 3,515,501 | A * | 6/1970 | Palfreyman | F01D 5/282 416/193 R |
| 4,270,256 | A | 6/1981 | Ewing et al. | |
| 4,494,287 | A | 1/1985 | Cruzen et al. | |
| 5,022,822 | A | 6/1991 | Sincere | |
| 5,263,823 | A | 11/1993 | Cabaret et al. | |
| 5,425,622 | A | 6/1995 | Murray et al. | |
| 5,536,145 | A | 7/1996 | Vandendriessche et al. | |
| 6,164,917 | A | 12/2000 | Frasier et al. | |
| 7,784,182 | B2 | 8/2010 | Carrier et al. | |
| 7,832,986 | B2 | 11/2010 | Baker et al. | |
| 8,123,487 | B2 | 2/2012 | Bayer et al. | |
| 8,206,117 | B2 | 6/2012 | Strangman et al. | |
| 8,282,355 | B2 | 10/2012 | Blanchard et al. | |
| 8,348,619 | B2 | 1/2013 | Derclaye et al. | |

(Continued)

FOREIGN PATENT DOCUMENTS

| | | | |
|---|---|---|---|
| DE | 102009052783 | A1 | 5/2011 |
| GB | 2050528 | A | 1/1981 |

OTHER PUBLICATIONS

European Patent Office, Extended European Search Report for EP Application No. 1519405.9-1610, dated Apr. 25, 2016, 9pgs.

*Primary Examiner* — Richard A Edgar
*Assistant Examiner* — Elton K Wong
(74) *Attorney, Agent, or Firm* — Duane Morris LLP

(57) ABSTRACT

A composite turbomachine comprises a hub comprised of fiber and resin and a plurality of blade assemblies. Each blade assembly comprises a blade, a base, and a tang. The plurality of blade assemblies are arranged circumferentially around the hub, each interlocking with an adjacent blade assembly and retained in position by the hub and a band overwrapping the respective tang of each of the plurality of blade assemblies.

20 Claims, 5 Drawing Sheets

(56) References Cited

U.S. PATENT DOCUMENTS

| | | | | |
|---|---|---|---|---|
| 8,408,874 | B2 | 4/2013 | McCaffrey et al. | |
| 2010/0150725 | A1 | 6/2010 | Krautheim | |
| 2010/0166560 | A1* | 7/2010 | Blanchard | F01D 5/282 416/214 A |
| 2011/0268561 | A1* | 11/2011 | Blanchard | F01D 5/282 415/174.4 |
| 2012/0003103 | A1 | 1/2012 | Tholath | |
| 2013/0064667 | A1 | 3/2013 | Campbell et al. | |
| 2013/0156590 | A1 | 6/2013 | Blanchard et al. | |
| 2013/0243601 | A1 | 9/2013 | Floyd | |
| 2015/0345296 | A1 | 12/2015 | Davidson et al. | |
| 2015/0354374 | A1 | 12/2015 | Hofer et al. | |
| 2016/0130957 | A1 | 5/2016 | Freeman et al. | |

* cited by examiner

COMPOSITE BLISK

FIELD OF THE DISCLOSURE

The present disclosure relates generally to turbomachinery, and more specifically to a composite blink (bladed disk) constructed from composite materials for use in axial-flow fluid compressors and other turbomachinery.

BACKGROUND

Axial-flow compressors are used in a variety of applications to compress a fluid from an inlet pressure to a discharge pressure which is higher than inlet pressure. Axial-flow compressors typically comprise a rotatable assembly of a plurality of blades mounted to a rotor and a static assembly of a plurality of vanes mounted to a casing. The cross-sectional area of the fluid passage in an axial-flow compressor typically decreases as the fluid travels from inlet to discharge. In operation, the rotating blades accelerate the fluid into the diminishing cross-sectional area, thus compressing or pressurizing the fluid.

Applications of axial-flow compressors include gas turbine engines, where an axial-flow compressor supplies high pressure air to a combustor. The rotor of the compressor may be coupled to at least a portion of the rotor of the turbine component in the gas turbine engine. In such applications, the weight of the compressor—and of the engine as a whole—can be a critical factor. For example, in aviation applications such as an axial-flow compressor used in an engine for an aircraft, missile, or other airborne element, the weight of the compressor can significantly affect performance, cost, and capabilities of the airborne element.

For this reason, recent interest has been shown in substituting metal engine components with those made of lightweight composite materials. In addition to weighing less than metal components, engine components fabricated from composite materials may demonstrate improved thermal properties and may have lower material and manufacturing costs than metal components. However, engine components fabricated from composite materials may also have drawbacks such as lower loading and stress tolerances.

It is thus desired for an improvement in the art of fabricating turbomachinery components, and particularly axial flow compressors, from composite materials to provide for a lighter and less expensive alternative to metal-based turbomachinery.

SUMMARY

The present application discloses one or more of the features recited in the appended claims and/or the following features which, alone or in any combination, may comprise patentable subject matter.

According to an aspect of the present disclosure, a composite turbomachine comprises a hub comprised of fiber and resin; the hub having a radially inner surface, a radially outer surface and a first edge; a plurality of blade assemblies, each one of the plurality of blade assemblies comprising a blade, a base having an outer portion, an inner portion, and a radially oriented leg connecting the outer portion and the inner portion, the base defining a slot opening between the outer portion and the inner portion and terminating at the radially oriented leg, wherein said slot receives the hub and the blade is mounted on the outer portion of the base, and a tang axially extending from the outer portion; and wherein the plurality of blade assemblies are arranged circumferentially around the hub, each interlocking with an adjacent blade assembly and retained in position by the hub and a band overwrapping the respective tang of each of the plurality of blade assemblies.

In some embodiments the band comprises a plurality of fibers interconnected by resin. In some embodiments the plurality of blade assemblies interlock with each other via side surfaces of the respective bases. In some embodiments the hub has a shape from the group consisting of cone, conical frustum, cylinder, paraboloid, hyperboloid and semi-spheroid. In some embodiments the plurality of blade assemblies are injected molded and encased in a metal alloy. In some embodiments the metal alloy is a nickel alloy.

In some embodiments each face of the blade assemblies includes a plurality of teeth that interlock with teeth on an adjacent face. In some embodiments the band is attached to the outer surface of the hub. In some embodiments the tang includes a radially inward oriented recess, the recess receiving the band. In some embodiments the inner portions of the plurality of blade assemblies form a spline. In some embodiments the spline comprises a plurality of keys. In some embodiments quantitatively the plurality of keys are not equal to the plurality of blade assemblies. In some embodiments the inner portions of the plurality of blade assemblies form a plurality of threads. In some embodiments the outer portions of the plurality of blades assemblies forth a continuous flow boundary, the flow boundary varying in radial distance along the axial direction.

According to another aspect of the present disclosure, a method of manufacturing a bladed hub of a turbo machine comprises winding fibers and resin over a mandrel to form a hub; attaching a plurality of blade assemblies circumferentially around the hub where each of the blade assemblies have a blade, a hook, and a tang; the blade extending radially outward from the hub, the hook extending radially inward from the hub, and the tang extending axially away from the blade; winding fibers and resin around the tang of each blade assembly; and curing the fibers and resin.

In some embodiments the method further comprises attaching the hub to a turbine shaft. In some embodiments the method further comprises forming the blade assemblies, wherein the step of forming the blade assemblies is selected from the group consisting of: forming a composite layup and covering the composite layup with a metal alloy; and injection molding the blade assemblies and encasing the blade assemblies with a metal alloy.

According to yet another aspect of the present disclosure, a blisk for an axial flow compressor comprises a hub adapted to be rotatable about an axis of rotation; a plurality of blade assemblies comprising a blade coupled to a platform member, the platform member having an outer portion, a inner portion and a radially oriented leg connecting the outer portion and the inner portion, and defining a slot opening between the outer portion and the inner portion, said slot receiving the hub; a tang axially extending from the outer portion; wherein the plurality of blade assemblies are circumferentially arranged on the hub in stages; and a wound band which at least partially covers the tang of each of the plurality of blade assemblies.

In some embodiments the inner portions of the plurality of blade assemblies define a plurality of keys located radially within the hub. In some embodiments the outer portions of the plurality of blades assemblies form a continuous flow boundary.

BRIEF DESCRIPTION OF THE DRAWINGS

The following will be apparent from elements of the figures, which are provided for illustrative purposes and are not necessarily to scale.

Figure 1:
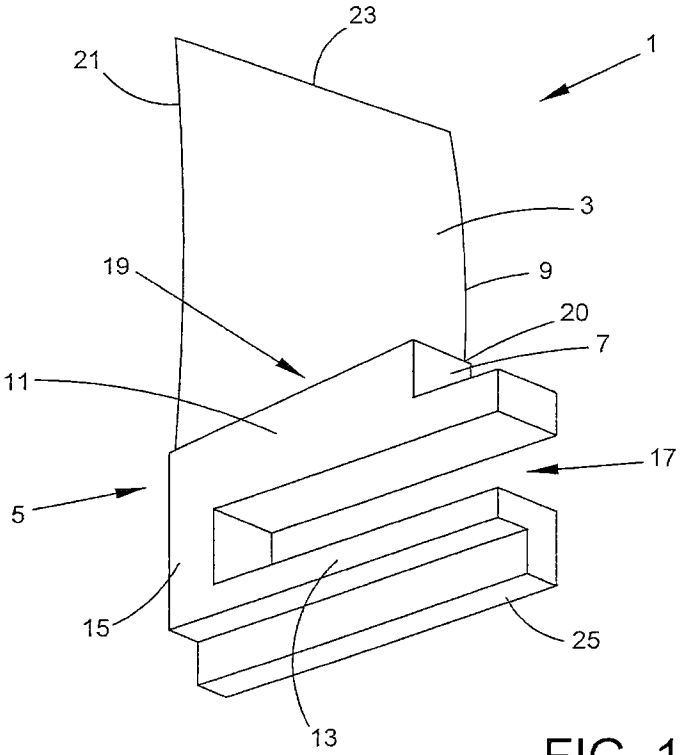
FIG. 1 is an isometric view of a blade segment in accordance with an embodiment of the present disclosure.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

For the purposes of promoting an understanding of the principles of the disclosure, reference will now be made to a number of illustrative embodiments illustrated in the drawings and specific language will be used to describe the same.

This disclosure presents turbomachinery systems and methods of fabricating and assembling turbomachinery with composite material components to achieve a lighter and less expensive compressor or other turbomachine components than is currently available in the art. More specifically, the present disclosure describes a blisk for an axial flow compressor which comprises a hub having a plurality of blade assemblies arranged on the hub as well as a spline within the hub and secured thereto by a slot and a wound band.

Figure 3:
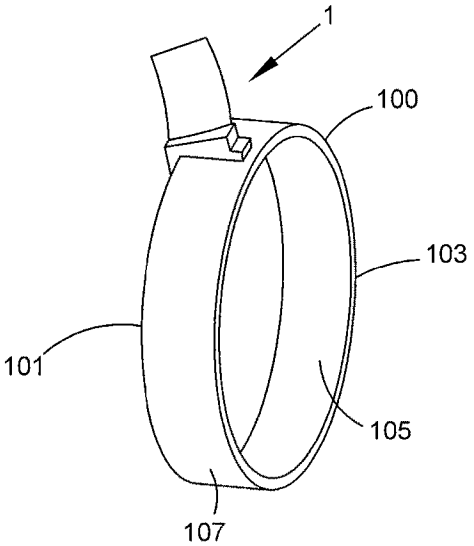
FIG. 3 is an isometric view of a blade segment engaged with a hub in accordance with an embodiment of the present disclosure.

A blade assembly 1 is illustrated in FIG. 1. The blade assembly 1 comprises a blade 3 and a base 5 (or platform). The base 5 has a tang 7 extending axially aft of a trailing edge 9 of the blade 3. As shown in FIG. 1, the base 5 having an outer portion 11, an inner portion 13, and a radially oriented leg 15 connecting the outer portion 11 and the inner portion 13. The inner portion 13 and outer portion 11 are with respect to the axis of the axis of rotation of the blisk. The base 5 defines a slot opening 17 between the outer portion 11 and the inner portion 13, terminating at the radially oriented leg 15. The slot 17 is configured to receive the hub 100 as shown in FIG. 3. In the embodiment shown in FIG. 1, the blade 3 is mounted on an upper surface 19 of the outer portion of the base 5. The blade 3 also has a leading edge 21 and a blade tip 23. The upper surface 19 forms a boundary of the flow path of the working fluid. Preferably, the radial position of the surface 19 varies axially.

Figure 6:
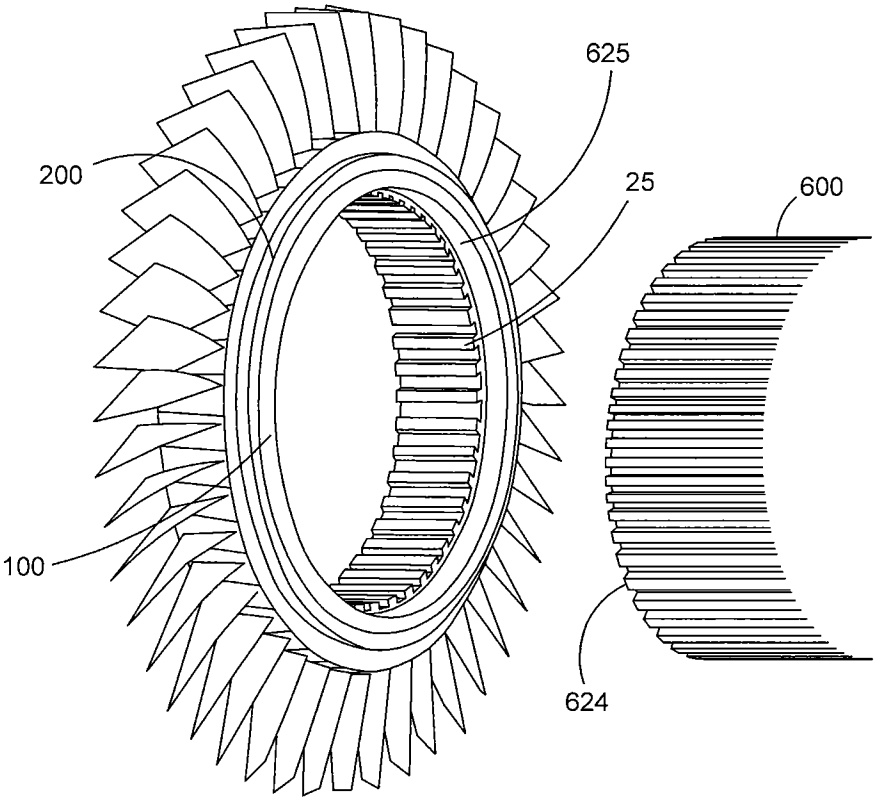
FIG. 6 is an isometric view of an assembled blisk and axial shaft according to an embodiment of the present disclosure.

The inner portion 13 includes a key 25 which is configured to be received by a key way 624 of an axial shaft 600 (shown in FIG. 6). In another embodiment, the inner portion 13 when coupled with other assemblies around a hub 100 (shown in FIG. 3) may form a threaded inner surface (not shown) for attachment to the shaft. The assembled inner portions 13 and respective keys 25 form a spline 625 as shown in FIG. 6.

Figure 2:
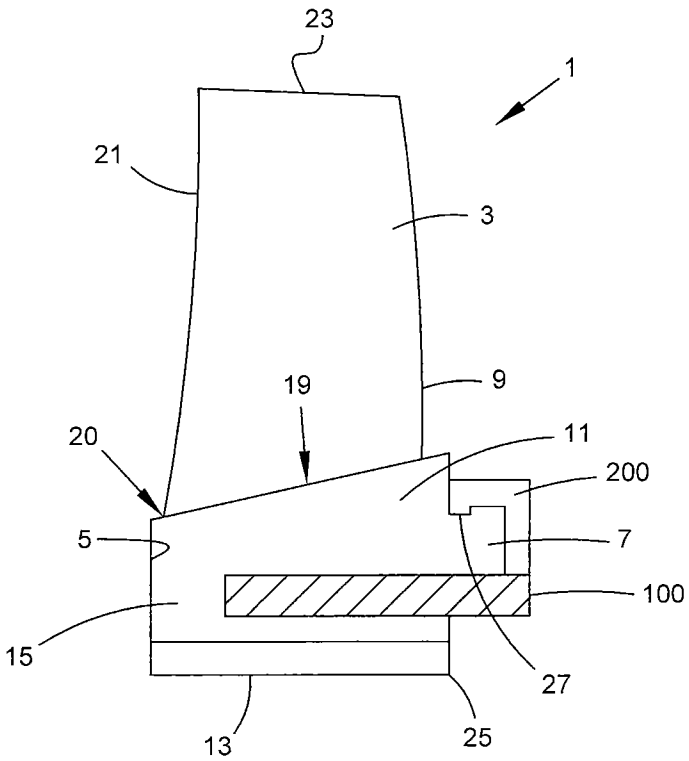
FIG. 2 is a cross section of a blade segment engaged with a hub in accordance with an embodiment of the present disclosure.

In FIG. 2, a cross sectional view of the blade assembly 1, the hub 100 is shown within the slot 17. A band 200 is wound over the tang 7 of the blade assembly 1 to hold the blade assembly 1 to the hub 100 under axial and radial loading. As can been seen in FIG. 2, a recess 27 in the tang 7 receives a portion of the band 200 and prevents axial movement of the blade assembly 1 relative to the hub 100 and further secures the band 200 to the blades assembly 1. The recess 27 may also be a plurality of recesses. In some embodiments the upper surface of the tang 7 may be an abrasive surface to prevent the band 200 from slipping off or may be of a material that crosslinks with the resin in the band 200.

FIG. 3 is an isometric view of a blade assembly 1 engaged with a hub 100. The blade assembly 1 receives the hub 100 in slot 17 (as shown in FIG. 2). The leading or upstream edge 101 of the hub 100 engages the leg portion 15 of the base 5. The hub 100 may have various shapes including but not limited to the shape of a cone, conical frustum, cylinder, paraboloid, hyperboloid or semi-spheroid. The shape of the hub 100 would typically be a function of the blade assembly 1, the flow path of the working fluid, and the shaft to which the blisk attaches. Alternatively, the downstream edge 103 may engage the leg portion 15 depending upon the expected axial loading.

The hub 100 is adapted to be rotatable about an axis passing therethrough. Hub 100 may be hollow, having a tubular structure which defines an interior surface 105 and exterior surface 107. In other embodiments, hub 100 has a constant circumference between the leading edge 101 and the trailing edge 103. As noted previously, the hub may take the shape of a cone, conical frustum, cylinder, paraboloid, hyperboloid, semi-spheroid or portion thereof. For example the hub may be a nose cone and thus of conical or paraboloid shape. In an embodiment in which the hub 100 forms a nose cone, the blade assembly 1 are preferably attached via the trailing edge 103.

The hub 100 may be fabricated as a single filament wound component. In some embodiments, hub 100 is fabricated from carbon fiber or glass fiber. The fiber or filament forming the hub 100 may be wound about a mandrel to achieve the desired size and shape. In some embodiments hub 100 is formed from metal or a metal-based compound or alloy. The hub 100 may also be assembled from numerous hub segments (not shown).

Resins may be used to bind together the wound fibers or filament and achieve the desired shape of hub 100. Appropriate resins may be selected based at least in part on an understanding of the likely maximum temperatures which the hub 100 will be subjected to during operation of the compressor 100. In relatively low temperature applications, various epoxies may be selected as the appropriate binding resin. In relatively high temperature applications, a high temperature resistant binding resin such as polysilazane may be used. The hub 100 may be fabricated using a resin transfer moulding process.

Figure 4:
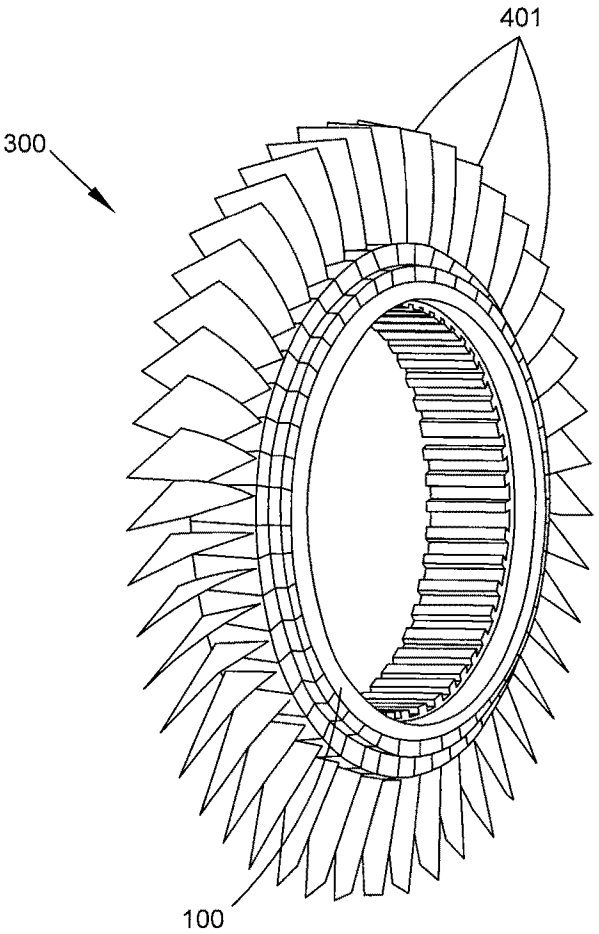
FIG. 4 is an isometric view of an assembled blisk hub in accordance with an embodiment of the present disclosure.

FIG. 4 presents an isometric view of a plurality of blade assemblies 401 arranged on the hub 100 in accordance with some embodiments of the present disclosure. FIG. 6 presents an isometric view of a plurality of blade assemblies 401 arranged on the hub 100 and retained by band 200 in accordance with some embodiments of the present disclosure.

In some embodiments the base 5 and blade 3 are integrally formed as a single component. Base 5 may also be referred to as a platform. As shown in FIGS. 1 and 3, blade 3 comprises a tip 23, root 20, leading edge 21, and trailing edge 9. Leading edge 21 is axially forward of trailing edge 9. A blade length l is defined between the tip 23 and root 20. The blade 3 may be joined, coupled, or mounted to the base 5 by the root 20 on the upper surface 19.

The bottom of the forward portion of the upper portion 11, or radially-inward facing surface, of base 5 may be contoured to match or substantially conform to the exterior surface 107 of hub 100.

Figure 5C:
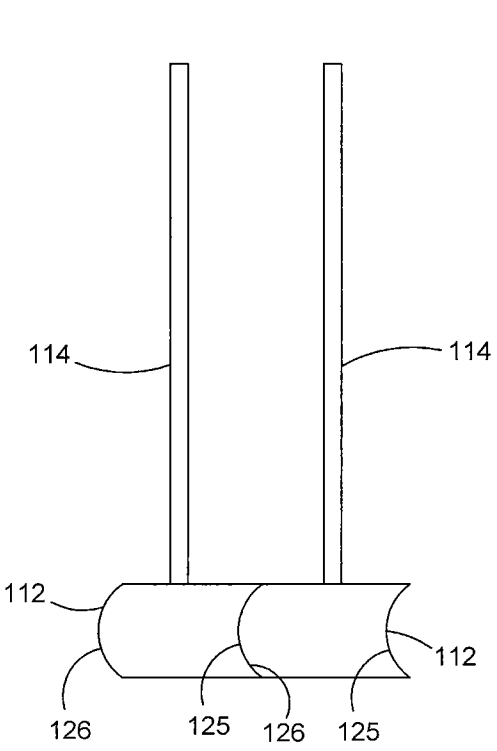
FIGS. 5A, 5B, and 5C are illustrations of the interconnection faces of adjacent blade segments according to embodiments of the present disclosure.
Figure 5B:
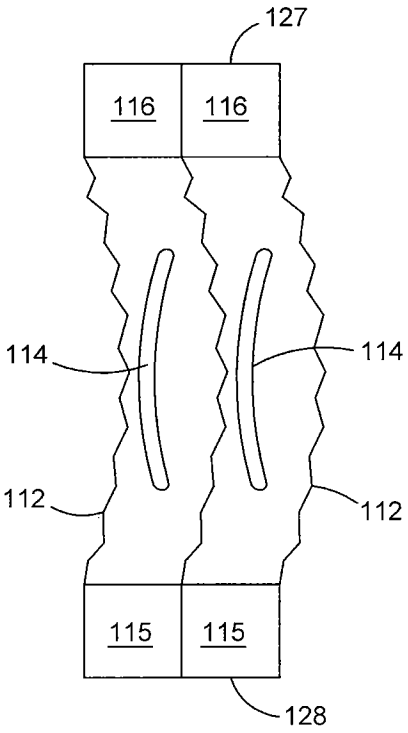
Figure 5A:
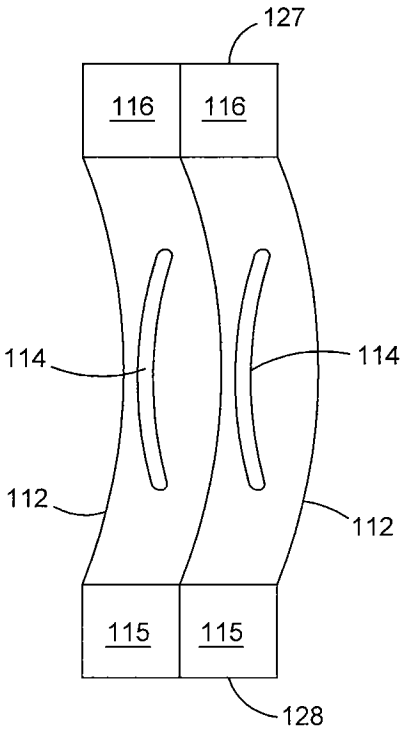

FIGS. 5A, 5B, and 5C are illustrations of the interconnection faces of adjacent blade segments according to embodiments of the present disclosure. The sides 125, 126 of the base 5 for each blade assembly 1 are preferably configured to join with adjacent blade assemblies when attached to hub 100. For example, as shown in FIGS. 5A and 5B in some embodiments base 5 has arcuate sides 125, 126 in either the axial or radial dimension, the arcuate sides 125, 126 adapted to interlock or match with adjacent base 5. In some embodiments, a blade assembly 1 may have both forward tang 116 and aft tang 115, and thus a forward most surface 127 and aft most surface 128 of the base 5 may be adapted to interlock or match with other bases 5 disposed adjacent in the axially forward or axially aft direction. In some embodiments, one of surface 127 and surface 128 may be concave and the other convex. In some embodiments, one or both of surface 127 and surface 128 comprise a toothed surface configured to interlock with a toothed surface of adjacent base 5. As another example, as shown in FIG. 5C sides 125, 126 may be toothed or patterned and thus adapted to interlock or match with adjacent base 5.

A plurality of blade assemblies 1 are used in the fabrication of the axial flow compressor 100. Each blade assembly 1 may be constructed using a resin transfer molding process. Each blade assembly 1 may be constructed using layers of fabric which are bonded and stiffened using a resin. As described above with respect to hub 100, an appropriate resin may be selected based on the specific application and the maximum design temperatures of the compressor. In some embodiments, at least one fabric layer used to construct a blade assembly 1 comprises boron or boron-based fibers, which may enhance the stiffness of blade 3 and blade assembly 1.

In some embodiments, blade 3 or blade assembly 1 may be coated with a protective material. For example, to protect the blade 3 and blade assembly 1 from oxidation, these components may be coated with Nanovate™. Nanovate is an electrodeposited (plated) nanocrystalline metal.

In some embodiments, blade 3 and blade assembly 1 may be manufactured by injection molding. The injection molding may use only resin as the constituent material of the blade 3 or blade assembly 1, or may use a mixture of resin and chopped fiber reinforcement. In some embodiments, exoskeleton materials are added to an injection molded blade 3 or blade assembly 1 to strengthen and protect those components. In some embodiments, an injection molded blade 3 or blade assembly 1 are coated with Nanovate™ or similar material. In some embodiments an injection molded blade 3 or blade assembly 1 is covered with a metal alloy, such as nickel alloy or cobalt alloy. In some embodiments exoskeleton structures are applied using an electro deposition process. In some embodiments a plastic or resin such as polyetheretherketone (PEEK) may be used to manufacture blade assembly 1, and the plastic or resin may include a fiber reinforcement of carbon or glass.

Blade assemblies 1 may be coupled to hub 100 using an adhesive, glue, epoxy, or similar material. The adhesive may be applied to the bottom and or top of the outer portion 11 and inner portion 13 of the blade assembly 1 respectively, or to both the bottom and side surfaces of each blade assembly 1 in order to couple each blade assembly 1 both to the hub 100 and to adjacent blade assemblies 1 in conjunction with the band 200. In some embodiments the adhesive is necessary only to hold blade assembly 1 to hub 100 while additional windings are added to form the band 200 which more permanently and securely bonds the blade assemblies 1 to hub 100.

In some embodiments the assembled blisk 300 may be used in conjunction with additional assembled blisks which may be arranged in stages. The stages may be arranged or spaced to provide a gap for stator vanes between the each blisk 300. In some embodiments a forward tang (not shown) extending upstream from the base 5 and the tang 7 are sized to create a gap when blade assemblies 1 are coupled to hub 100 such that forward tangs and tang 7 of adjacent stages of blade assemblies 1 are in contact. In other embodiments spacers may separate the stages, the spacers may also be similarly formed in the same manner of the blisk 300 absent the blades.

In some embodiments each of the blisks 300 have an equal blade length l. In some embodiments different stages have blisks of different blade lengths l. In some embodiments the axially forward stage of blade assemblies 1 have a blade length l which is longer than the blade length l of the blade assemblies 1 of the axially aft stage. In some embodiments the blade length l decreases from the axially forward stage to the axially aft stage.

In some embodiments blade assemblies 1 may be arranged on hub 100 substantially parallel to the axis of rotation. In other embodiments blade assemblies 1 may be arranged on hub 100 at an angle relative to the axis of rotation of the shaft 600.

Once the plurality of blade assemblies 1 are coupled to hub 100 in stages, an annular band (wound band) 200 is added which serves as the primary means for holding the blade assemblies 1 to hub 100. Annular band 200 comprises a wound layer or layers of fiber or filament which is wound about tang 7 of base 5. Resin may be used to cure or harden the fibrous band. In some embodiments, band 200 covers the radially outward facing surfaces of tang of the plurality of blade assemblies 1.

Band 200 must have sufficient strength along with the slotted base 5 to withstand the centrifugal loading of the blade assemblies 1 during operation of the blisk.

Once the blisk 300 is assembled as described above, it is coupled to a rotatable shaft 600. In coupling the blisk 300 to the shaft 600, the spline 625 which is composed of a plurality of keys 25 on the plurality of blade assemblies 401 engage the keyways 624 of the shaft 600. Alternatively, the inner portion 13 of the plurality of blade assemblies 401 may form threads, in which case the shaft 600 is complementarily threaded to receive the blisk 300. An anti-rotation device such as a catch or key may be used to restrict rotation, thus securing the blisk 300 to the shaft 600. It should be noted that the number of keys 25 formed by the plurality of blade assemblies 401 need not be equal. For example, two or more adjacent blade assemblies 1 may only form one key 25. Similarly, a single blade assembly 1 may form multiple keys 25.

In the assembly of the blisk, a first step includes winding fibers and resin over a mandrel to form the hub 100; next the blade assemblies 1 are attached circumferentially around the leading edge 21 and winding additional fibers and resin around the hub 100 to form an annular band 200 around the tangs 7. The fibers and resin of the annular band 200 are then cured. Alternatively, the band may be a preformed composite or metal structure that is glued or mechanically fasten to the tang 7.

The disclosed blisk as described above has numerous and varied applications in the field of fluid compression. Such applications include, but are not limited to, aviation applications such as gas turbine engines for aircraft and unmanned aerial vehicles (UAVs), expendable compressor applications such as for missile propulsion systems, land- and sea-based gas turbine engines providing electrical generation and/or propulsion, and any rotating machinery generally. Likewise, other turbomachineary, such as turbines, vanes and centrifugal compressors are also envisioned being arranged in accordance with this disclosure.

The present disclosure provides many advantages over previous axial flow compressors. By constructing a rotatable assembly entirely or partially from composite materials, the rotatable assembly achieves a significant reduction in weight. Particularly for aviation application, this weight reduction provides a substantial advantage over prior art compressors fabricated extensively from metals and metal-based materials. The use of composite materials when fabricating the compressor may additionally lead to a cost savings due to lower prices of raw materials used in the compressor. Additional cost savings may be achieved through the reduction or elimination of numerous fasteners, discs, and seal assemblies currently required in advanced compressor designs. Finally, yet further cost savings may be achieved by faster and more simple manufacturing processes which are afforded by the rotatable assembly presently disclosed.

Although examples are illustrated and described herein, embodiments are nevertheless not limited to the details shown, since various modifications and structural changes may be made therein by those of ordinary skill within the scope and range of equivalents of the claims.

What is claimed is:

1. A composite turbomachine comprising:

a hub comprised of fiber and resin; the hub having a radially inner surface, a radially outer surface and a first edge;

a plurality of blade assemblies, each one of the plurality of blade assemblies comprising:

a blade;

a base having an outer portion, an inner portion, and a radially oriented leg connecting the outer portion and the inner portion, the base defining a slot opening between the outer portion and the inner portion and terminating at the radially oriented leg, wherein said slot receives the hub and the blade is mounted on the outer portion of the base;

a tang axially extending from the outer portion; and wherein the plurality of blade assemblies are arranged circumferentially around the hub, each interlocking with an adjacent blade assembly and retained in position by the hub and a band overwrapping the respective tang of each of the plurality of blade assemblies.

2. The turbomachine of claim 1, wherein the band comprises a plurality of fibers interconnected by resin.

3. The turbomachine of claim 1, wherein the plurality of blade assemblies interlock with each other via side surfaces of the respective bases.

4. The turbomachine of claim 3, wherein each face of the blade assemblies includes a plurality of teeth that interlock with teeth on an adjacent face.

5. The turbomachine of claim 1, wherein the hub has a shape from the group consisting of cone, conical frustum, cylinder, paraboloid, hyperboloid and semi-spheroid.

6. The turbomachine of claim 1, wherein the plurality of blade assemblies are injected molded and encased in a metal alloy.

7. The turbomachine of claim 6, wherein the metal alloy is a nickel alloy.

8. The turbomachine of claim 1, wherein the band is attached to the outer surface of the hub.

9. The turbomachine of claim 1, wherein the tang includes a radially inward oriented recess, the recess receiving the band.

10. The turbomachine of claim 1, wherein the inner portions of the plurality of blade assemblies form a spline.

11. The turbomachine of claim 10, wherein the spline comprises a plurality of keys.

12. The turbomachine of claim 11, wherein quantitatively the plurality of keys are not equal to the plurality of blade assemblies.

13. The turbomachine of claim 1, wherein the inner portions of the plurality of blade assemblies form a plurality of threads.

14. The turbomachine of claim 1, wherein the outer portions of the plurality of blades assemblies form a continuous flow boundary, the flow boundary varying in radial distance along the axial direction.

15. A method of manufacturing a bladed hub of a turbo machine comprising:

winding fibers and resin over a mandrel to form a hub;

attaching a plurality of blade assemblies circumferentially around the hub where each of the blade assemblies have a blade, a hook, and a tang; the blade extending radially outward from the hub, the hook extending radially inward from the hub, and the tang extending axially away from the blade;

winding fibers and resin around the tang of each blade assembly; and curing the fibers and resin.

16. The method of claim 15, further comprising attaching the hub to a turbine shaft.

17. The method of claim 15, further comprising forming the blade assemblies, wherein the step of forming the blade assemblies is selected from the group consisting of:

forming a composite layup and covering the composite layup with a metal alloy; and injection molding the blade assemblies and encasing the blade assemblies with a metal alloy.

18. A blisk for an axial flow compressor comprising:

a hub adapted to be rotatable about an axis of rotation;

a plurality of blade assemblies comprising a blade coupled to a platform member, the platform member having an outer portion, a inner portion and a radially oriented leg connecting the outer portion and the inner portion, and defining a slot opening between the outer portion and the inner portion, said slot receiving the hub; a tang axially extending from the outer portion; wherein the plurality of blade assemblies are circumferentially arranged on the hub in stages; and a wound band which at least partially covers the tang of each of the plurality of blade assemblies.

19. The blisk of claim 18, wherein the inner portions of the plurality of blade assemblies define a plurality of keys located radially within the hub.

20. The blisk of claim 18, wherein the outer portions of the plurality of blades assemblies form a continuous flow boundary.

* * * * *